United States Patent [19]

Arendt

[11] Patent Number: 4,570,978

[45] Date of Patent: Feb. 18, 1986

[54] ROTARY COUPLING FOR A PLURALITY OF INDEPENDENT FLUIDS

[76] Inventor: Hans F. Arendt, Industriestrasse 32, 7126 Sersheim, Fed. Rep. of Germany

[21] Appl. No.: 492,478

[22] Filed: May 6, 1983

[30] Foreign Application Priority Data

May 8, 1982 [DE] Fed. Rep. of Germany ..... 3217462

[51] Int. Cl.[4] ..... B05B 3/02

[52] U.S. Cl. ..... 285/131; 285/134; 285/136; 285/151; 239/214

[58] Field of Search ..... 285/134, 136, 131, 151, 285/190; 239/246, 223, 214 X

[56] References Cited

U.S. PATENT DOCUMENTS

| | | | |
|---|---|---|---|
| 4,052,090 | 10/1977 | Stafford | 285/136 |
| 4,288,106 | 9/1981 | Foolen | 285/136 |
| 4,405,162 | 9/1983 | Williams | 285/190 |
| 4,441,522 | 4/1984 | Griffin | 285/190 |

FOREIGN PATENT DOCUMENTS

| | | | |
|---|---|---|---|
| 1016426 | 1/1966 | United Kingdom | 285/151 |
| 0495493 | 12/1975 | U.S.S.R. | 285/136 |
| 0602739 | 4/1978 | U.S.S.R. | 285/136 |
| 0709909 | 1/1980 | U.S.S.R. | 285/136 |

*Primary Examiner*—Cornelius J. Husar
*Assistant Examiner*—Eric K. Nicholson
*Attorney, Agent, or Firm*—Burton, Parker & Schramm

[57] ABSTRACT

A rotary coupling for the introduction of liquid and/or gaseous media into the drum of a continuous flow washing machine movable in the housing possessing a number of annular chambers (64, 66, 68, 69, 71) arranged coaxially to one another and separated from one another, which are formed between two separating disks (55, 63, 65, 67, 70, 72). In the middle region of each annular chamber, at least one pipe connection (91, 84) is introduced which is led out from the device in the axial direction outward, penetrating the adjacent annular chambers in a liquid and/or gas tight manner. In addition, radially outward running pipe connections (97) enter the annular chambers, and moreover, each annular chamber is contructed by housing elements of the first and second kind (51, 55 . . .) rotatable against each other, of which each of the first kind and of the second kind at any given time is arranged to revolve around each other. The housing elements of the first kind are formed with the construction by a pot-like housing in which the annular chambers are contained, and the housing elements of the second kind are formed by the separating walls which are held at a distance from each other by means of spacers (60). The separating walls and the spacers are pressed against each other by a central screw capped bolt (80, 83, 82), and are held revolving in the housing (51) by means of bearings (53, 73).

9 Claims, 5 Drawing Figures

ROTARY COUPLING FOR A PLURALITY OF INDEPENDENT FLUIDS

DESCRIPTION

1. Field of Invention

This invention relates to the field of rotary couplings for a plurality of independent fluids. More particularly, this invention relates to a rotary coupling for the introduction of liquid or gaseous media into the drum of a continuous flow washing machine.

2. Background of the Invention

In a continuous flow washing machine the media used as washing, rinsing and bleaching agents, as well as superheated steam, must frequently be introduced into specified portions of the rotating drum. Because of the rotation of the drum, the feed pipes with known washing machines are generally introduced into the drum loading side as an assembly of pipes or in the form of concentric pipes, whereby, however, the supporting on the drum wall causes difficulties, and a supporting at the discharge side can hinder the discharge. Also, the assembly of pipes, even if placed in a hollow shaft, can impair the washing process.

It is further known to provide outside of the drum at the specified input places, connecting through a series of holes with the internal space of the drum, annular channels whose cylindrical outer wall consists of two elastic annulus shaped parts with sealing lips pressed against each other at the joining line. With a probe of spindle shaped cross section, the pair of sealing lips can be opened for addition of media. This form of construction is reliable in function, but the manufacturing is expensive, and the service life, especially of the sealing lips, is severely limited.

SUMMARY OF THE INVENTION

The purpose of this invention is the creation of a device for the introduction of liquid and/or gaseous media which makes possible the fastening of feed pipes to the drum wall of a continuous flow washing machine, which is simple in construction and has good durability.

I have invented a simple durable rotary swivel for the introduction of liquid and/or gaseous media into a rotating drum of a washing machine. My rotary coupling is comprised of a first housing having a plurality of first radial coupling means at least for each of the independent fluids to be used. A second housing juxtaposing the first housing and defines a plurality of annular chambers, at least one chamber for each of the independent fluids. The annular chambers are arranged coaxially, each annular chamber being bounded by two annular discs. Each annular chamber communicates with at least one first coupling means in the first housing. The rotary coupling is equipped with means for holding the housings of the first and second kind for their rotation relative to one another about the axis of the annular chambers. The second housing has a plurality of second coupling means extending generally parallel to the axis of rotation, at least one coupling means for each of the independent fluids to be communicated. Each of the second coupling means communicates with at least one annular chamber whereby fluid communication is made between a first and a second coupling means for the transmission of fluids as the first and second housing rotate relative to one another.

There are at least two embodiments of this invention which solve the problems associated with the prior art.

The first embodiment of the rotary coupling is constructed using a first housing of pot-like construction and a second housing contained therein forming a plurality of annular chambers with disks acting as separating walls which are held at a distance from one another by means of spacers whereby the inner wall of the pot-like first housing confines the annular chamber on the outer side. The second coupling means being formed by axial passageways which pass through the disks or separating walls and the first coupling means being formed by passageways in the first housing which extend radially from the annular chambers.

A second embodiment of the invention has the annular chambers formed by annular grooves and annular disks of the first and second kind. A plurality of disks of the first kind form the first housing, and a plurality of disks of the second kind form the second housing. Annular disks of the second kind are connected to axial pipes forming the second coupling means which extend generally parallel to the axis of rotation and the annular disks of the first kind are connected to first passageways running radially. As the annular disks of the first kind rotate together relative to the annular disks of the second kind, fluid communication is maintained between the first coupling means formed by passageways which extend radially from the first housing and the second passageways which extend generally axially from the second housing.

Thus with both constructions, annular chambers are formed to which the media may be supplied in the axial direction and from which the media are conducted out in the radial direction, through radially running pipe connections. With the first embodiment, the separating walls are jointly rotatable within the housing relative to it, and with the second solution the annular disks of the first kind are rotatable with respect to the annular disks of the second kind, whereby they are alternately arranged against each other, and by that, at any given time the annular disks of the first kind or the annular disks of the second kind are rotationally firmly connected with one another, so that all annular disks of the first kind can rotate relative to the annular disks of the second kind. In this way it is achieved that the device can be so fastened to the washing machine that the axially running pipelines are rotated, whereas the radially running pipelines are arranged stationary, and vice versa.

While the rotary coupling described herein and shown in the drawing was developed for a continuous flow washing machine, the scope of the invention is not limited to this application alone. It is envisioned that this rotary coupling may be used in numerous applications where it is necessary to transmit liquid between two parts which rotate relative one another.

By means of the drawings, in which some construction examples are presented, the invention as well as additional advantageous refinements and imprrovements and further advantages will be explained in detail and described.

BRIEF DESCRIPTION OF THE PREFERRED EMBODIMENT

Figure 3:
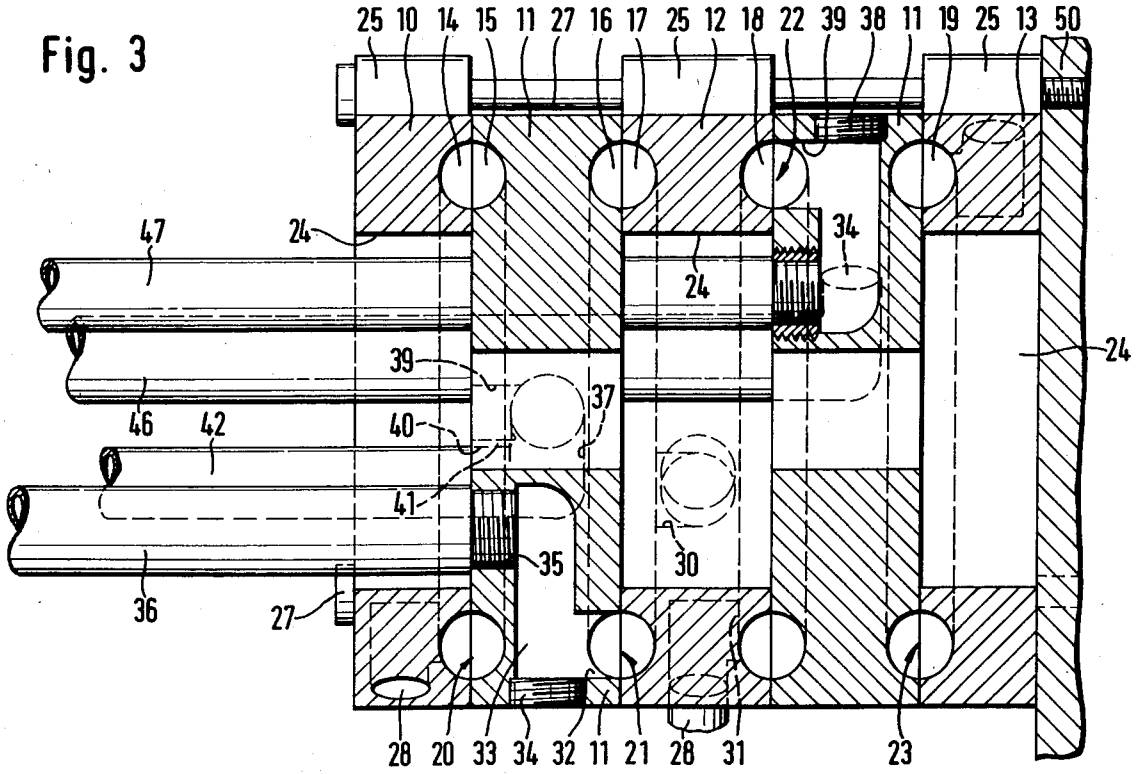
FIG. 3 is an axial section through the device with the annular disks according to FIGS. 1 and 2.

First of all, it will be taken up with respect to FIG. 3. This shows a sectional view through a device according to a first construction example of the invention.

The device consists of several annular disks which are arranged coaxially to each other, namely, an annular disk 10 of the first kind, thereafter subsequently an annular disk 11 of the second kind, thereafter subsequently again an annular disk 12 which is similar to the annular disk 10, thereafter subsequently another annular disk 11 of the second kind, and as a closing, an annular disk 13 which is similar to annular disks 10 and 12. The annular disk 10 possesses on one face an annular groove 14, whereas the annular disk 11 has annular grooves 15 and 16 on both faces. On the annular disk 12—similar to annular disk 11—annular grooves 17 and 18 are constructed, and on annular disk 13, also an annular groove 19 is provided on one face. The directly opposite annular grooves 14 and 15 of the annular disks 10 and 11 respectively, define an annular chamber 20; the annular grooves 16 and 17 of the annular disks 11 and 12 form another annular chamber 21; between the two annular disks 11 and 12 a third annular chamber 22 is formed, and between the two annular disks 11 and 13, on the right side, a fourth annular chamber 23 is formed.

Figure 1:
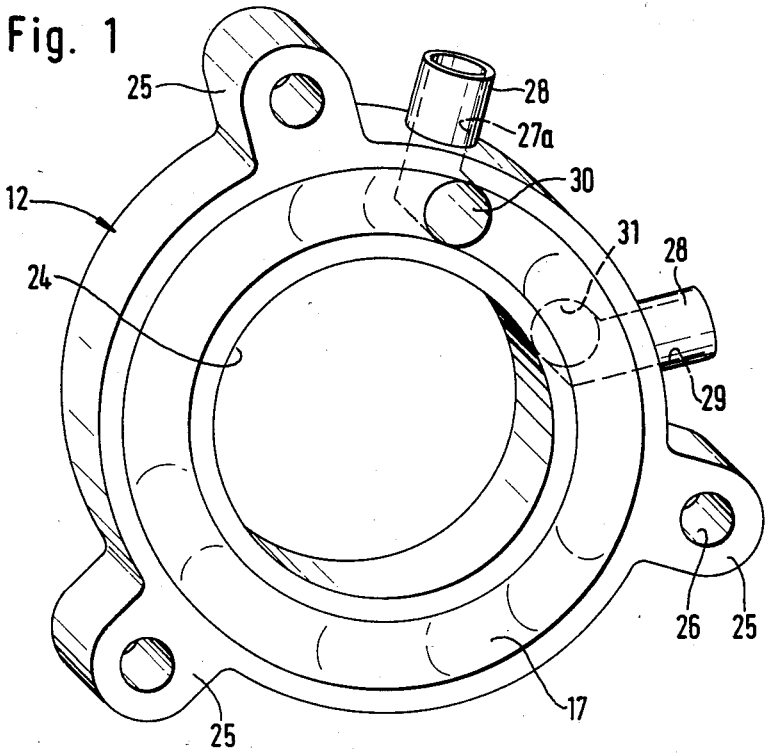
FIG. 1 is a perspective view of an annular disk of the first kind for the device.

FIG. 1 shows a perspective view of the annular disk 12, with the annular groove 17 and a central opening 24. Annular disks 10 and 13 are the same as annular disk 12, according to FIG. 1; a difference exists only in that annular disk 12 has annular grooves on both faces, whereas the annular disks 10 and 13 have an annular groove only on one face. All the annular disks 10, 12 and 13, which are designated as first annular disks or as annular disks of the first kind, possess on the circumference, uniformly distributed projections 25 with drilled holes 26. Tightening scews 27 pass through the drilled holes, with which the annular disks 10, 12 and 13 of the first kind are attached to each other so that they are not rotatable around one another.

The annular disk 12 possesses, as is evident from FIG. 1, two radial channels 27*a* and 29 which end in radially running connecting elements 28, whereby the one channel 27*a* discharges through an axial opening 30 into the annular groove 17, and the other channel 29 discharges through an axial opening 31 into the annular groove 18.

Figure 2:
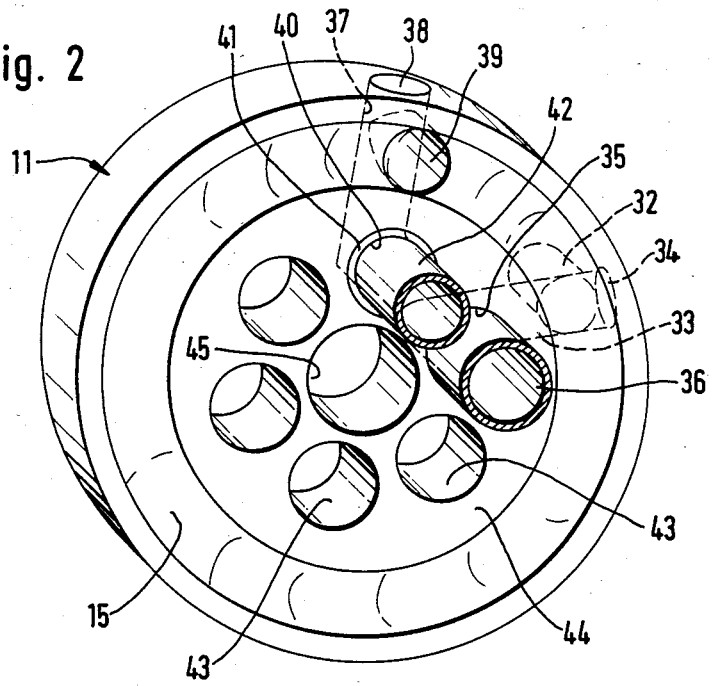
FIG. 2 is a view of an annular disk of the second kind for the device.

The annular disk 11 of the second kind is drawn in perspective presentation in FIG. 2. It is so presented that the face is considered into which the annular groove 16 is introduced. Into this annular groove 16, a channel 32 running in the axial direction discharges, which forms a connection between the annular groove 16 and a radially running channel 33 (such as channels 27*a* and 29) which is drilled from outside and is sealed on the outer side by means of a threaded plug 34.

The radially running channel 33 ends inside in a drilled hole 35 which opens up on the face with the annular groove, and to which a pipe connection is fastened. One recognizes from FIG. 3 that the opening or drilled hole 32 on the one face and the opening or drilled hole 35 on the other side finally connect with the annular groove 15. About 60 degrees displaced is a second radial channel 37 drilled from the outside to the inside, which is sealed on the outside with a plug. Channel 37 is connected with the annular groove 15 by means of a transversely drilled hole 39 and discharges inside into an open drilled hole 40 on the same face, in which by means of a threaded connection 41 or reducing union 41, another pipe 42 is connected. The other pipe 42 is smaller in diameter than pipe 36. If the reducing union 41 would not be provided, then the external diameter of the pipe 36 could be as large as that of pipe 42.

Furthermore, the annular disk 11 possesses four additional openings 43 into a central region 44 which completely penetrate the central region 44, in contrast to the drilled holes 35 and 40, and are distributed uniformly with the two drilled holes at the outer edge of the internal region 44, thus are distributed within the area defined by the annular grooves 15 and 16. These openings 43 and drilled holes 35 and 40 jointly surround a central opening or a central drilled hole 45.

With a refinement of FIG. 2, the drilled holes 35 and 40 are not continuous, but discharge only into the radial channels 37 or 33; the possibility naturally exists of making these drilled holes continuous, and to seal them on the opposite side by means of threaded plugs like the threaded plugs 34 and 38.

Referring once again to Figure number 3, the annular disk 11 lying on the right, which thus lies between the annular disks 12 and 13, is constructed exactly like the annular disk situated on the left, with the channels 39 and threaded plugs 38 and the threaded plugs 34; it is built in displaced only about 120° or even 180°. With the annular disk 11 situated on the right, in a similar manner as pipes 36 and 42, connecting pipes are connected with 46 and 47.

The directly opposite annular grooves form the annular chambers 20 to 23 which are connected with radially outward running connections 28 through channels located in the annular disks of the first kind, whereas the annular chambers formed in the annular disks of the second kind, namely, by means of the channels running in the annular disks 11, are connected with those running in the axial direction at the pipe connections 36, 42, 46 and 47 attached to the annular disks of the second kind. The screw bolts 27 are screwed into a frame 50 by the arrangement according to FIG. 3. The openings 43 (see FIG. 2) which are located in FIG. 3 on the left annular disk, are penetrated by the pipes 46 and 47; if more than two annular disks of the second kind are provided, then two additional pipes can penetrate the annular disk located on the left and the annular disk located on the right of the drawing in FIG. 3, if one assumes that the two additional annular disks are of the right kind, thus are arranged on the side of the frame.

The openings 43 possess a diameter which permits a shoving through of the largest pipes used. The central opening is considered as a reserve, and purposely has a somewhat larger diameter.

The annular disks of the first and second kind in the device, as mentioned above and as is evident from FIG. 3, are laid in alternating sequence to each other, and by means of the tightening screw bolt 27, are fastened to the frame or to a front wall 50 of the washing machine, coaxially with this. With fastening to a frame, the annular disks of the first kind 10, 12 and 13 are fixed; with fastening to the front wall of the washing machine, they are connected rotatably with the drum of the washing machine. In the first case, thus the annular disks of the second kind rotate together with the pipe connections 36, 42, 46 and 47, whereas in the second case, the annular disks of the first kind rotate and the pipes remain fixed. If the pipes 36, 42, 46 and 47 are used as feed pipes for the media to be fed to the washing process, then the media arrives through the channels 33, 39 in the annular chambers 20 or 21 and 22 or 23, and from these through the channels 27*a* or 29 to the pipe connection 28. The pipelines connected to these pipe connectors or connecting elements can be tightly connected with the drum wall if, as shown, the device is fastened coaxially with the washing machine on its front side 50. The pipes 36, 42, 46 and 47 connected with fixed feed pipes prevent a rotation of the annular disks 11 of the second kind. The torsional strength is still raised in such a way that the pipes 46 and 47 are led through the openings of the subsequent annular disk or the annular disk lying before it. Conversely, if the annular disks 10, 12 and 13 are held rotationally fixed on a frame, the supplying of the media takes place through the connection 28, and the pipes 36, 42, 46 and 47 are to be firmly connected to the drum, whereby they cause the annular disks 11 of the second kind to run together with them.

The annular disks 10 and 13 of the first kind shown on the ends of FIG. 3 are only provided on one face, namely, the inner face, with grooves 14 and 19; but there is nothing against also using annular disks provided with grooves on both faces. Then the device can be expanded in a simple manner by the use of additional annular disks, so long as the number of pipe connections and openings permits.

Hereby, the effortless addition to the structure makes the symmetrical arrangement of the openings possible. For lowering of the number of required annular disks, the annular disks can be provided with two annular grooves on one or both faces. For the sealing of the opposite face of the annular disks, seals (gaskets) can be arranged between these which, for instance, can be constructed as slip rings, whereby at any given time, one slip ring corresponds to the surface situated outside of the annular groove of the annular disk 10, 11 or 13 of the first kind, and a second corresponds to the part of the surface lying within the annular groove of the annular disk 11 of the second kind (not presented).

It is understandably possible to arrange an annular groove at any given time only on one face of each annular disk; in order to obtain the same annular chamber cross section, then the annular groove is only to be constructed deeper, and the drilled holes 37 and 39 then end, not in an annular groove, but on the smooth surface opposite to the annular groove of the annular disk lying opposite.

Figure 4:
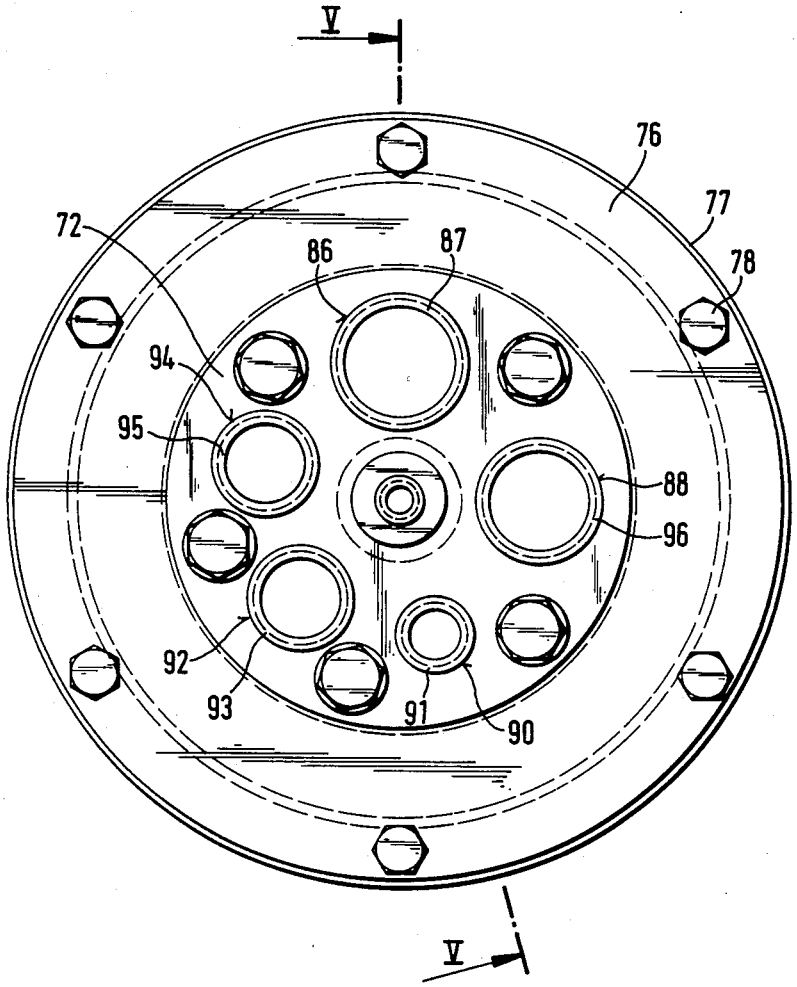
FIG. 4 is a top view of the device in the arrow direction A of FIG. 5.
Figure 5:
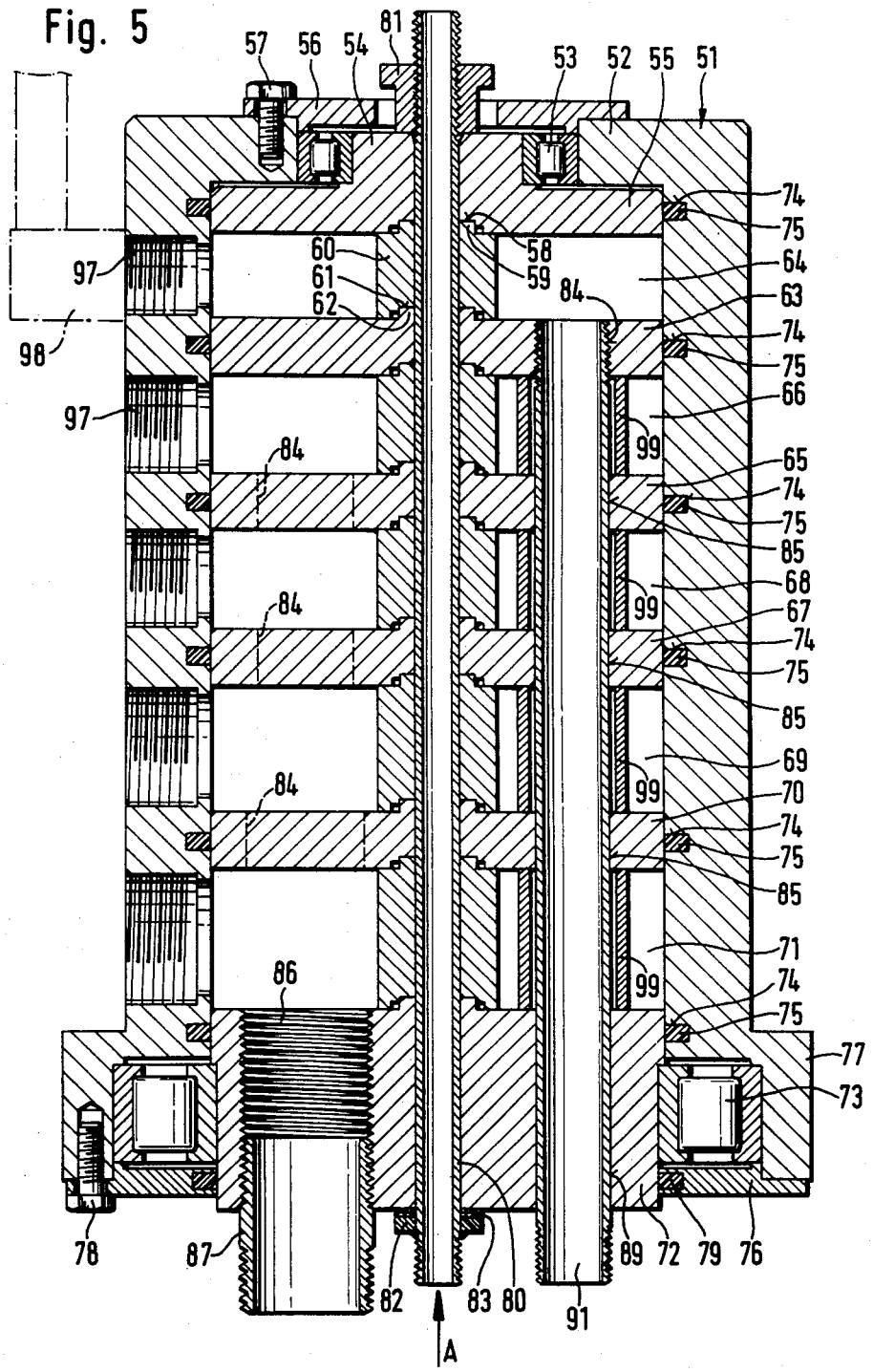
FIG. 5 is a sectional view according to the line V—V of FIG. 4.

The annular chambers 20, 21, 22 and 23 can also be formed in the same way, as is presented in FIGS. 4 and 5. The device according to FIG. 5, which will be first referred to, possesses a pot-like housing 51 that on its one end, in FIG. 5 the upper end, has an inward running collar 52 which surrounds a roller bearing or ball bearing 53. The roller bearing itself consists of an annular shoulder 54 which is formed on a first separating disk 55. On the outer side of the flange or of the collar 52, a closing cover 56 is fastened by means of bolt connections 57 which serve for holding of the bearing 53. The surface of the separating disk opposite to the shoulder 54 possesses a central cavity 58 which accepts an extension 59 of a spacer 60, and therewith guides the spacer 60.

On the opposite side of the extension 50 is located a cavity 61, in which an extension 62 of a second separating disk 63 interlocks. On this separating disk 63 a spacer is again included, and on this spacer again a separating disk, and so on. Between the separating disk 55 and the separating disk 63, an annular chamber space 64 is formed; between the separating disks 63 and 65, another annular chamber space 66; on this is connected an annular chamber space 68 which is confined by a separating disk 67; the separating disk 67 on one side and a separating disk 70 on the other side confine an annular chamber space 69. Finally, an annular chamber space 71 is formed which is confined by a closing disk 42. The annular chamber spaces 64, 66, 68, 69 and 71 are separated from each other by means of the spacers 60 of equal spacing; in the same way, the closing disk 72 is also separated from the separating wall 70 with the formation of an annular chamber space 71 by means of a spacer.

The closing piece is again surrounded by a bearing 73 that can be a roller bearing or a ball bearing. In the region of the circumference edges of the separating disks 55, 63, 65, 67 and 70, grooves 74 are provided in the housing 51 in which gaskets 75 are laid. In the region of the closing piece on the one side, the inner side of the bearing 73, a groove 74 with a fastened in or laid in gasket 75 is also provided, which is fastened on the face of an extension 77 of the housing 51 by means of screw bolt connections. The cover encloses the closing disk 72 with intermediate arrangement of a gasket 79.

FIG. 4 shows a view of the device in the arrow direction A. One recognizes on the circumference the extension 77 of the housing 51 as well as of the cover 76 which is fastened to the housing 51 by means of the bolts 78. The cover 76 encloses the closing disk 72. As is evident from FIG. 5, the closing disk 72 has penetrated the separating disks and the spacers centrally with a central pipe 80 that at one end is screwed into a plug which extends beyond, whereas at the other end, thus at the lower end of FIG. 5, a disk 82 is firmly welded on, whereby between the closing disk 72 and the disk 82 a spring pack is provided that presses the separating disks 55 to 70 as well as the closing disk 72, together over the spacers. The holding of the entire arrangement of separating disks with the spacers and the central piece or the central pipe 80, takes place by means of the bearings and the closing cover 56 or 76.

The individual separating disks 63, 65, 67, 70, possess openings and threaded drilled holes; on the separating disk 63 only a threaded drilled hole or an opening furnished with internal threads is provided, whereas the separating disks 65, 67 and 70 have openings 85 as well as threaded openings. These threaded openings are drawn displaced, whereby their task is described further below in detail.

In the same way, the closing disk 72 possesses a threaded drilled hole 86, and additional threaded drilled holes 88, 90, 92 and 94. In FIG. 5 it is evident that in the threaded drilled hole 86 a pipe connection 87 is screwed in. Instead of the threaded drilled hole 90 shown in the drawing FIG. 4, also only a simple opening 89 can be provided, through which a pipe 91 passes that penetrates all the separating disks and is screwed into the separating disk 63 in its threaded drilled hole. In addition, not shown in FIG. 5 but to be seen well in FIG. 4, pipe pieces 93, 95 and 96 can pass through corresponding holes which are introduced instead of the threaded drilled holes in the closing disk, and thereby run to separating disk 65, separating disk 67 and separating disk 70.

The pipe 91 thus passes through all the annular chambers 66, 68, 69 and 71, and discharges into the first annular chamber 64. The annular chamber 64 is supplied with a pipe connection 97 to which a dashed line drawn connecting pipe 98 is connected. An additional pipe that is not drawn here, ends in the annular chamber space 66, and this annular chamber space is also equipped with a radially outward running pipe connection which here also has the reference numeral 97. By means of the gaskets surrounding the pipe, the pipeline 91 and the remaining pipelines 93, 95 and 96 are sealed off from the region of the annular chamber space, so that through the openings 84 and 85, no medium from one annular chamber space can arrive in the other annular chamber space.

The mode of operation of the device according to FIGS. 4 and 5 is the same as that of FIGS. 1 to 3: Through the central drilled holes or pipe connections and pipes 91, 93, 95 and 96 as well as 87, the media are fed to the individual annular chamber spaces, and discharged through the discharging pipe connection 97. Now the housing 51 can be arranged stationary; then the separating disks and the pipes 91 to 96 and the pipe piece 87 can rotate, whereby the closing disk 72 is simultaneously rotated with them. Conversely, the possibility exists of connection the housing with the drum so that the housing rotates, whereas the separating disks 55 to 70, the closing disk 72, the pipes 91 to 96 then stand still.

It is understandably possible to form the device according to the invention in another way also. It is always essential that one or more annular chamber spaces are fed media through central, axially running pipe connections and that media are discharged through radially running pipe connections, or vice versa. The housing parts which form the annular chamber spaces are rotatable relative to each other, so that with a first kind of mounting, the one housing part is fixed and the housing part guiding the axially running pipes is rotatable, or the housing part guiding the pipes in the axial direction is fixed, and the housing part provided with the radial connections is arranged rotatably.

I claim:

1. Apparatus for transmitting liquid and/or gaseous fluids between two parts rotating relative to one another, comprising:

a first housing formed by a plurality of axially spaced apart disks of a first kind arranged coaxially about an axis and each having at least one face generally perpendicular to said axis;

a second housing formed of one or more disks of a second kind coaxial with said axis and having at least one face generally perpendicular to said axis for rotatably cooperating with said disks of the first kind along with their faces, defining therebetween a plurality of annular chambers coaxial with said axis;

a first coupling means for fluid transmission within the first housing for communication with each annular chamber and projecting radially outwards therefrom; and second coupling means for fluid transmission in the second housing for communication with each annular chamber and projecting axially therefrom;

whereby fluid may be independently transmitted through the annular chamber to connect a first and second coupling means during the rotation of the first or second housings relative to one another.

2. The invention of claim 1 wherein said disk of the first and second kind are alternatively coaxially arranged to one another in series.

3. The invention of claim 2 wherein the disks of each kind are held rotationally fixed relative to the same kind.

4. The invention of claim 3 wherein the disks of the first kind are annular in shape having an opening in the central region concentric with the axis, and the disks of the second kind are provided with a central region about the axis, the general size of the opening of the adjacent disk of the first kind.

5. The invention of claim 4 wherein the second coupling means further comprises:

transverse channels formed in the disk of the second kind communicating with the annular chambers and extending inwardly to the central region of the disk; and pipes fixed to the disk of the second kind communicating with the transverse channels and extending axially out of the apparatus passing through the central regions of adjacent disks as required.

6. The invention of claim 5 wherein the annular chambers are formed by at least one annular groove formed in the face of at least one disk.

7. The invention of claim 5 wherein the annular chamber is formed by a pair of annular grooves formed at opposite faces of cooperating disks of the first and second kind.

8. The invention of claim 5 wherein the disks of the first kind are further provided with a plurality of holes parellel to the axis and uniformly spaced about the circumference of the disks, and the first housing further comprising a plurality of bolts extending through the holes in the circumference of the disks of the first kind and maintained in tension to hold the disks of the first kind compressed axially together further preventing relative rotation thereof.

9. The invention of claim 8 having a plurality of annular chambers for the transmission of independent fluids defined by two or more disks of the second kind, wherein the pipes forming the second coupling means cooperate with the central region of the disks of the second kind rotably fixing disks of the second kind together.

* * * * *